US008371206B1

(12) United States Patent
Albrecht et al.

(10) Patent No.: US 8,371,206 B1
(45) Date of Patent: Feb. 12, 2013

(54) WEDGE-TYPE BREECHBLOCK BIDIRECTIONAL MAKE-BREAK ASSEMBLY

(75) Inventors: Jeffrey Albrecht, Schenectady, NY (US); Matthew Woelfersheim, Cambridge, NY (US); Michael Palage, Loudonville, NY (US); James Papandrea, Slingerlands, NY (US); Mohamed Badawi, Niskayuna, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 5 days.

(21) Appl. No.: 12/749,700

(22) Filed: Mar. 30, 2010

Related U.S. Application Data

(60) Provisional application No. 61/164,515, filed on Mar. 30, 2009.

(51) Int. Cl.
*F41A 19/00* (2006.01)

(52) U.S. Cl. ..... 89/28.05; 89/28.1; 89/135

(58) Field of Classification Search ..... 89/28.05, 89/28.1, 28.2, 135, 18.11; 42/84
See application file for complete search history.

(56) References Cited

U.S. PATENT DOCUMENTS

| | | | | |
|---|---|---|---|---|
| 4,070,557 | A * | 1/1978 | Ostapovitch | 200/51.1 |
| 6,085,629 | A * | 7/2000 | Thiesen et al. | 89/6.5 |
| 6,543,330 | B2 * | 4/2003 | Breuer et al. | 89/28.05 |
| 7,086,319 | B2 * | 8/2006 | Larroque-Lahitette et al. | 89/28.1 |

* cited by examiner

*Primary Examiner* — Daniel J Troy
(74) *Attorney, Agent, or Firm* — Henry S. Goldfine

(57) ABSTRACT

A gun with a wedge-type breechblock containing a single make-break junction assembly, located between the stationary mass of the cradle and the breechblock. The make-break junction assembly having a first set of contacts located along the bottom of the ramp structure affixed to the cradle and a second set of contacts housed in a shoe affixed to the bottom of the breechblock, at a location corresponding to the first set of contacts. Such that, when the breechblock is in-battery and the gun loaded, this shoe will be aligned with and adjacent to the first set of contacts, so that the make-break circuit will be completed.

4 Claims, 8 Drawing Sheets

WEDGE-TYPE BREECHBLOCK BIDIRECTIONAL MAKE-BREAK ASSEMBLY

CROSS REFERENCE TO RELATED APPLICATIONS

This application claims the benefit under 35 USC §119(e) of U.S. provisional patent application 61/164,515, filed on Mar. 30, 2009, which provisional application is co-pending herewith, and is hereby incorporated by reference.

FEDERAL RESEARCH STATEMENT

The inventions described herein may be manufactured, used and licensed by, or for the U.S. Government, for U.S. Government purposes.

BACKGROUND OF INVENTION

1. Field of the Invention

The present invention relates to the firing and data transmission circuitry for wedge type gun breechblocks, and more particularly, to the make-break feature of such circuitry between the non-recoiling mass of the gun cradle and the gun breechblock.

2. Related Art

Modern combat tanks, such as the Abrams main battle tank produced in the United States, carry large 120 mm caliber guns which electronically fire cartridges. Such guns usually include a gun barrel that is seated in a non-recoiling cradle; a breech ring located at the breech end of said gun barrel, which recoils longitudinally with the axis of the barrel's bore; and held within that breech ring is a wedge-type breechblock, that counter-recoils transversely to the axis of the barrel's bore to provide clearance for reloading the gun. Conventionally, disposed in the wedge-type breechblock is an ignition transmission unit, which unit can be displaced axially, counter to the pressure of a spring, from a retracted position into an extended position from the face of the breechblock unit to contact the cartridge, and is electrically connected via an ignition line to a contact device, e.g. a fire control computer, electrically connected via circuitry disposed on the stationary cradle.

As just stated, wedge-type breechblocks are conventionally designed to traverse longitudinally in a rearward direction with the recoil of the gun upon firing and to use that momentum to continue longitudinally rearwards, so as to space the breech mechanism away from the fixed cradle or non-recoiling mass. As the wedge-type breechblock returns to its in-battery position, against the cradle during counter-recoil, it also moves downward, transversely, to clear the gun tube for reloading. Finally, after the gun is reloaded, the breechblock snaps vertically, so that the face plate thereof is aligned with the loaded cartridge. Considering the fact that wedge-type breechblocks are experiencing such bi-directional motion, conventionally the ignition circuitry has been designed with two make-breaks to interface the circuitry from the stationary cradle structure into the wedge-type breechblock. The first "longitudinal" make-break is located so as to complete its contact when the wedge-type breechblock is in-battery, having completed its longitudinal motion back against the cradle after counter-recoil. The second "transverse" make-break is located so as to complete its contact when the wedge-type breechblock has completed its transverse motion and is back in alignment with the bore, and cartridge.

U.S. Pat. No. 6,543,330, incorporated herein by reference, discloses combination circuitry in which an ignition contact is disposed against the cartridge bottom for producing a connection to an external current source, and a signal contact is disposed against a connection ring also on the cartridge bottom, connecting to an external electronic control and evaluation device. However, the disclosed combination circuitry continues to use the conventional longitudinal and transverse sets of make-breaks of the prior art.

While U.S. Pat. No. 6,543,330 does simplify the circuitry within wedge-type breechblocks by combining ignition and signal transmission circuitry, it still utilizes a complex system of two sets of make-breaks, longitudinal and transverse make-breaks, to connect the circuitry from the stationary cradle to breechblock. Thus there is a need in the art for a simpler make-break system that utilizes only a single make-break, thereby reducing cost and creating a much more reliable electronic system, i.e. by eliminating half of the contacts which may fail if blocked by any foreign, insulating, matter.

SUMMARY OF INVENTION

The present invention relates to a simple and relatively inexpensive ignition and/or signal transmission circuitry system within a wedge-type breechblock, utilized in 120 mm, 105 mm and similar guns; which circuitry, utilizes only a single set of make-break contacts located between the ramp structure affixed to the stationary mass of the cradle and the wedge-type breechblock which rides up on that ramp structure. The first set of contacts within the subject single make-break are suspended in a contacting housing hanging down from a point generally central to the bottom of the ramp—these first set of contacts are electrically connected to an external control computer which controls a current source to ignite the cartridge and is capable of evaluating signals from the cartridge and of controlling any electronics within the cartridge, including setting the cartridge fuse. The second set of contacts within the subject single make-break are electrically connected to the cartridge, these contacts are housed in a shoe affixed to the bottom of the breechblock; such that, when the breechblock is in-battery and the gun loaded, this shoe will be aligned with and be adjacent to the suspended housing; thereby bringing the second set of contacts into alignment, contact and mating with the first set of contacts.

The particular location of the inventive make-break is such, so that when the gun is fired and the breechblock is in recoil, the contacts will separate, the second set of contacts moving rearward from the gun longitudinally—initially breaking the firing, monitoring, and control circuits. After, the recoil the breechblock will simultaneously move downward, transversely, and back longitudinally to be in-battery against the cradle—but, the contacts will still be separated transversely, the circuits open. However, when the gun is reloaded, the breechblock moving vertically, i.e. transversely, the two sets of the make-break contacts will again reengage and mate one to the other, completing the circuit and the gun again be ready to fire.

In a preferred embodiment, to ensure that the connection between the first set of contacts and the second set of contacts within the subject inventive make-break achieves a physically solid, secure, electrical contact, at least one set of contacts should be spring loaded. In one particular preferred embodiment, the first set of contacts can be elongated metal strips, which are spring loaded to extend outward from the contact housing to mate with the second set of contacts, which can be fixed pins extending from the side of the shoe facing toward the first set of contacts, i.e. the face of the shoe. It is so preferred that the first set of contacts be in the form of elongated metal fixings, such that the alignment between the first and second sets of contacts need not be perfect to ensure good contact, i.e. mating of the contacts and a completed circuit.

Further features and advantages of the present invention will be set forth in, or apparent from, the detailed description of preferred embodiments thereof which follows.

DETAILED DESCRIPTION

As discussed above, the present invention is a simplified ignition and data transmission circuit for 120 mm, 105 mm and similar weapons which employ a wedge-type breechblock assembly, which circuit contains only a single make-break junction assembly. The subject circuit connects the fire control computer to the cartridge loaded into the weapon, whereby the computer can fire the cartridge by sending a current source to ignite the cartridge, as well as, evaluating any signals from the cartridge and controlling any electronics within the cartridge, including setting the cartridge fuse.

Figure 1:
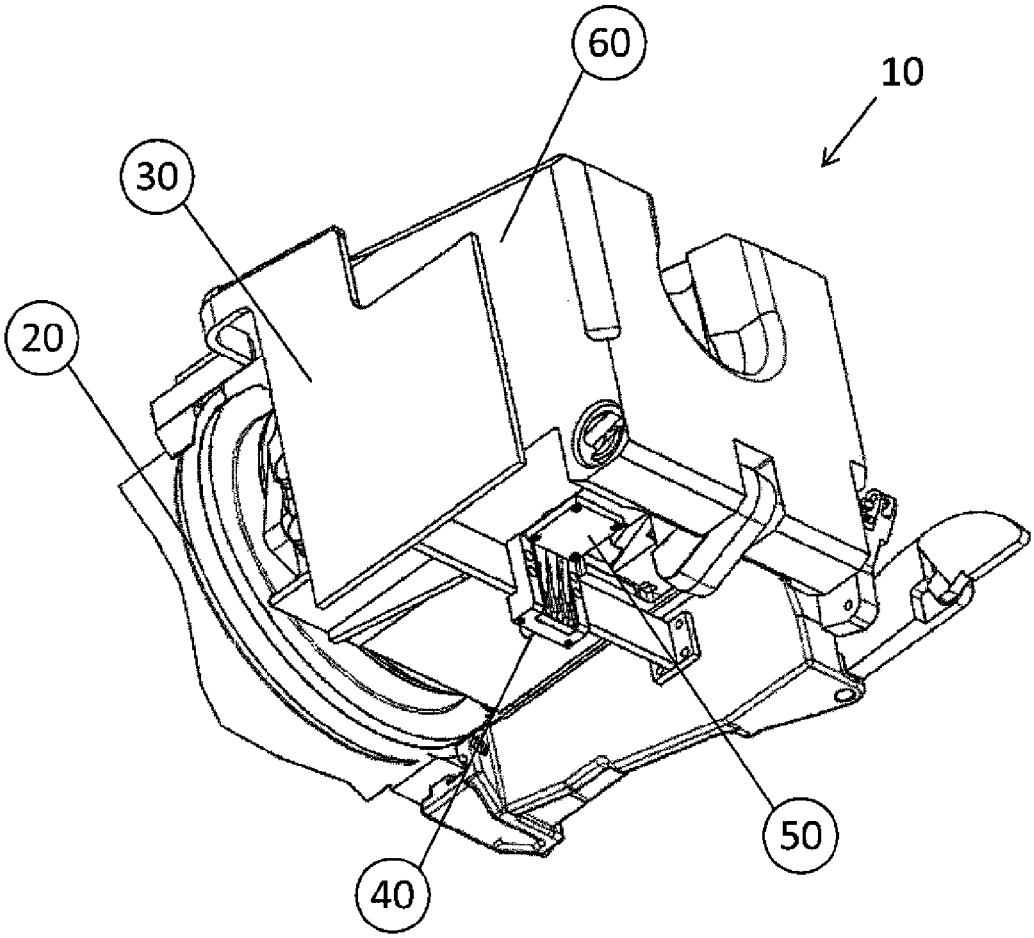
FIG. 1 is a perspective view of the breech mechanism and a section of the cradle cut-away from the balance of its supporting non-recoiling mass, showing the breech mechanism in-battery and loaded, wherein the make-break assembly of the present invention is made—such that the firing and control circuits contained therein are complete.
Figure 2:
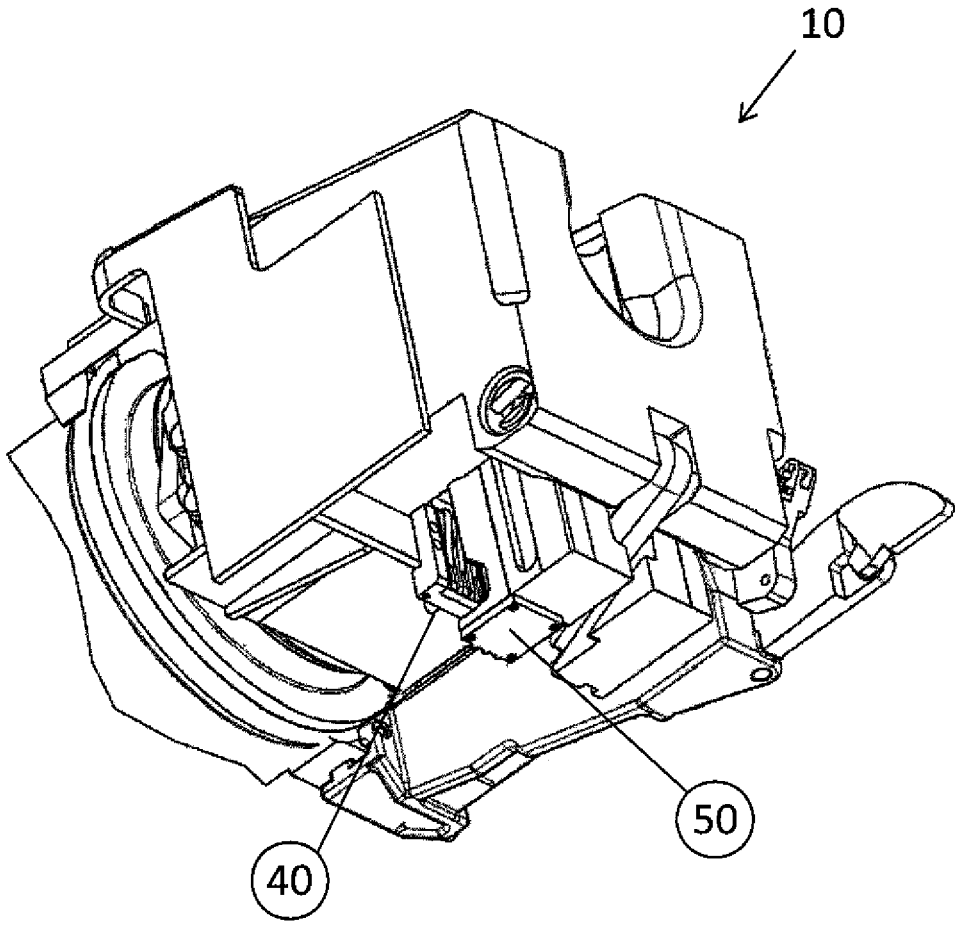
FIG. 2 is a perspective view of the breech mechanism and a section of the cradle cut-away from the balance of its supporting non-recoiling mass of FIG. 1, showing the breech mechanism in battery, after counter-recoil, but not loaded; such that, the make-break assembly of the present invention is broken and the firing and control circuits contained therein are not complete.
Figure 3:
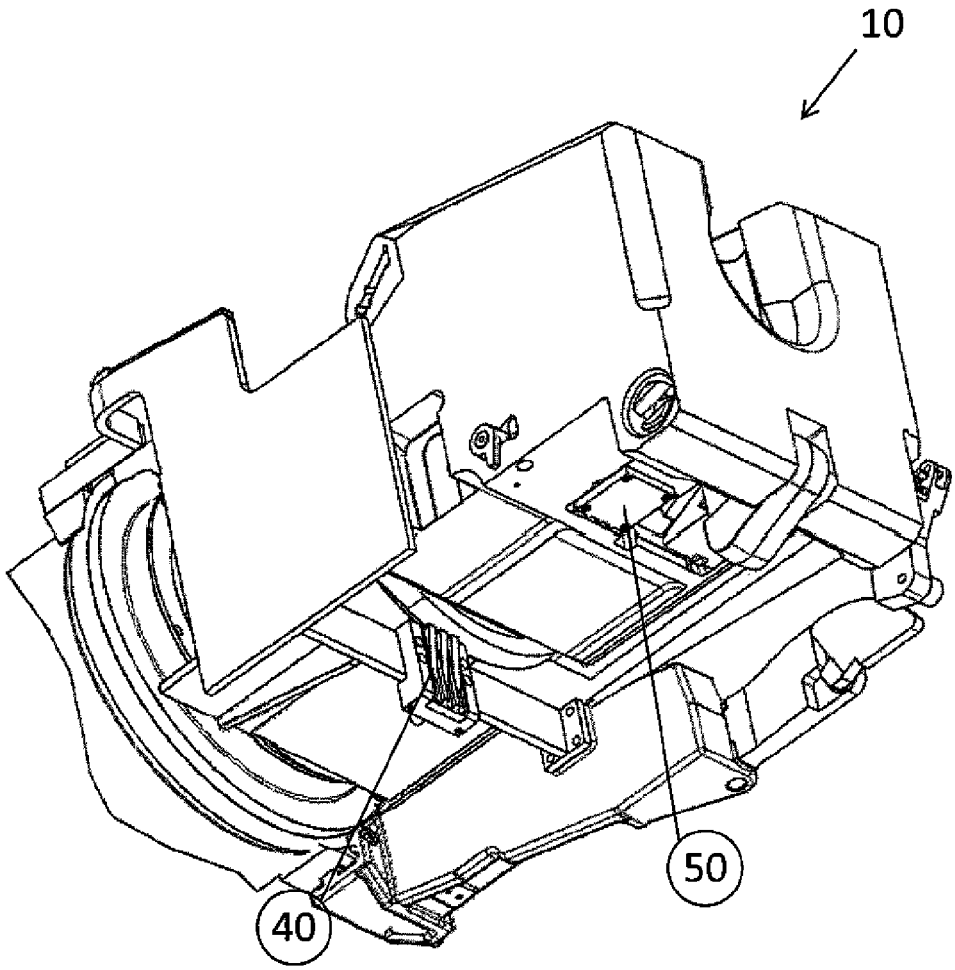
FIG. 3 is a perspective view of the breech mechanism and a section of the cradle cut-away from the balance of its supporting non-recoiling mass of FIG. 1, showing the breech mechanism significantly open (apparently near the end of recoil or the beginning of counter-recoil); such that, the make-break assembly of the present invention is broken and the firing and control circuits contained therein are not complete.

As shown in FIGS. 1, 2, and 3, detailing a breech mechanism 10 of the present invention, a ramp mounting bracket assembly 30 is affixed to the non-recoiling mass, or cradle 20, of the 120 mm, 105 mm or similar weapon employing a wedge-type breechblock assembly. A contact housing on the ramp 40 is positioned generally central to the lower front side thereof (facing in the direction of recoil)—though it can be positioned along the length of that front side. At a corresponding point, along the corresponding edge of the base of the breechblock is a shoe assembly 50, located such that it will align with the contact housing on the ramp 40 and mate closely thereto, forming the make-break connection when the breech mechanism 10 is in-battery and loaded—as illustrated in FIG. 1. When the breech mechanism recoils, the shoe assembly 50 and the contact housing on the ramp 40 will separate, as illustrated in FIG. 3, breaking the make-break connection (clearly, the shoe has moved longitudinally away from the contact housing on the ramp 40). Further, when the breechblock returns to battery and is again adjacent the cradle, it will be initially in the position shown in FIG. 2, transversely "down" from its initial position as shown in FIG. 1 (a position which provides an open pathway into the bore to allow loading of a cartridge therein). After the cartridge is loaded, the breechblock transverses vertically "up" into its loaded position and the contacts within the contact housing on the ramp 40 and shoe assembly 50 will reengage and the make-break circuit will be reestablished. Advantageously, the mass of the breechblock will tend to shield the make-break contact between the shoe assembly 50 and the contact housing on the ramp 40; whereas, prior art two make-break connections were located along a side of the breech ring holding the breechblock 60—areas not so shielded from debris.

Figure 4:
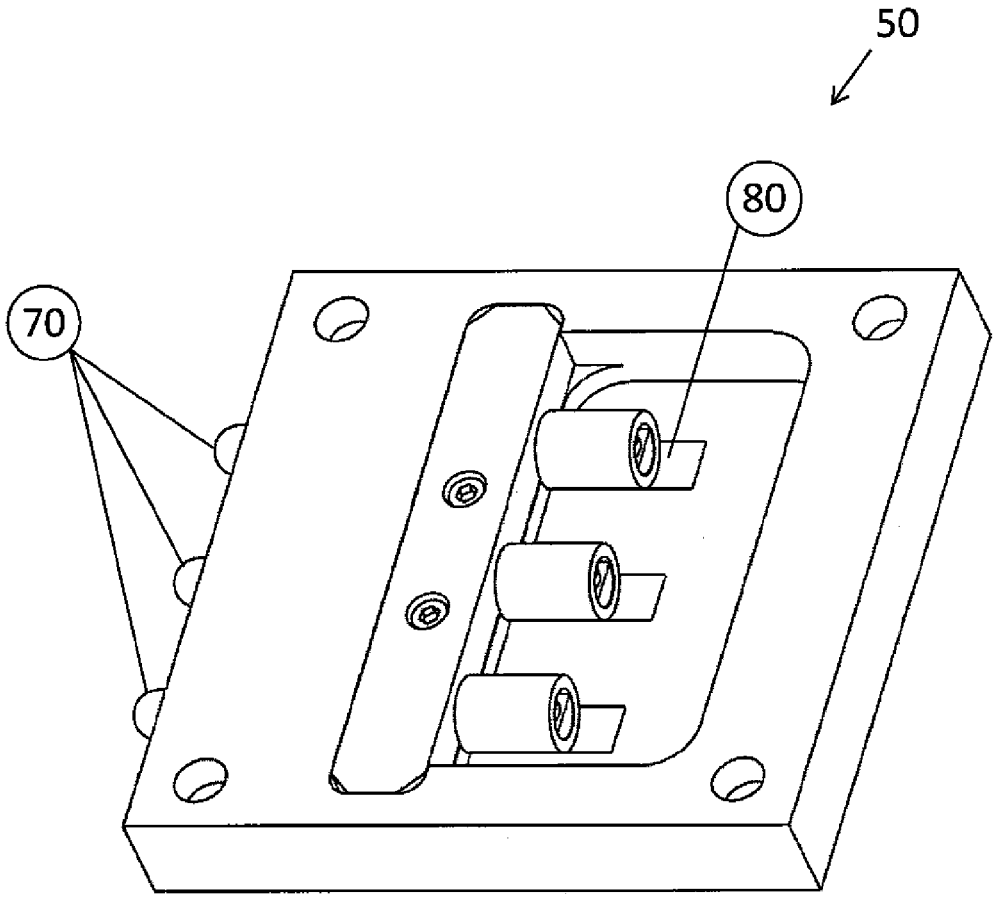
FIG. 4 is a top perspective view of an embodiment of the shoe assembly, which comprises the contacts of the inventive make-break assembly located on the base of the breechblock.

Referring to FIG. 4, a detail of the top side of the shoe assembly 50 is shown, which shows the shoe contact pins 70 that mate to the elongated contacts within the contact housing on the ramp 40 to complete the make-break circuit, when the gun is in-battery and loaded. Not shown in FIG. 4, are the connections extending from the pins to the face plate of the breechblock adjacent to the rear of the cartridge—the connections which transmit the ignition signal and any desired monitoring or control signals. These connections are made within and extend from the depression in the shoe 80.

Figure 5:
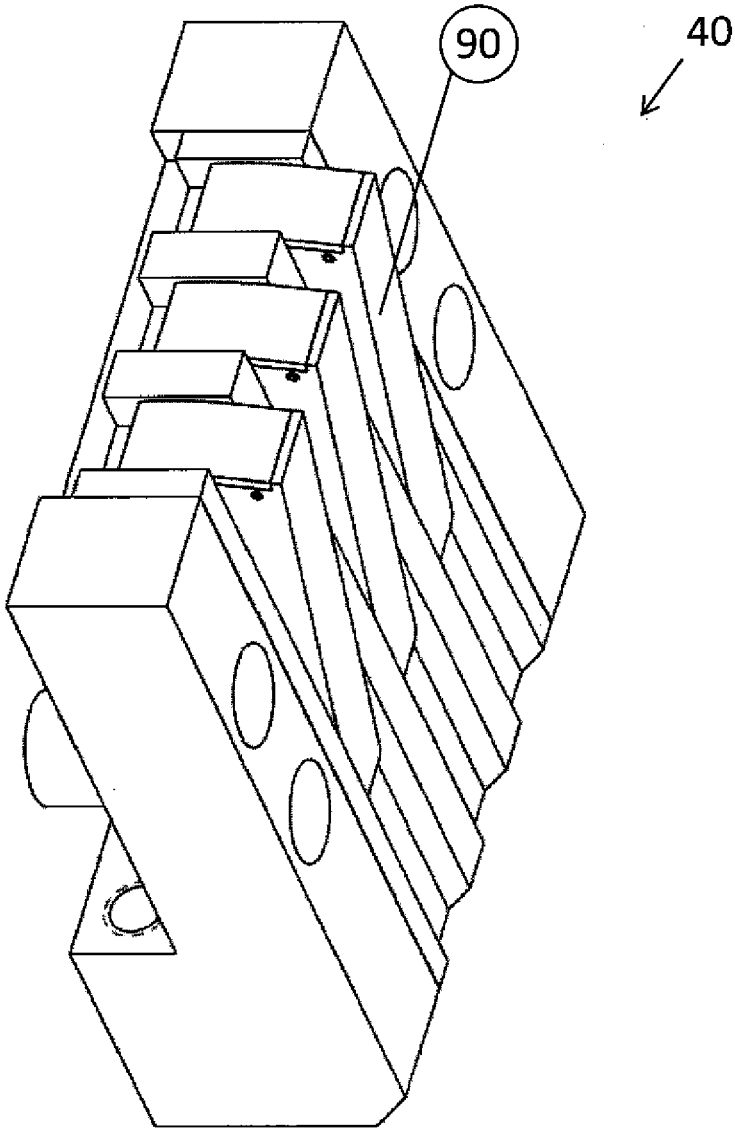
FIG. 5 is a perspective view of an embodiment of the contact housing assembly, showing three contacts, all in a forward position, which housing assembly comprises the portion of the inventive make-break assembly located on the non-recoiling ramp assembly.
Figure 6:
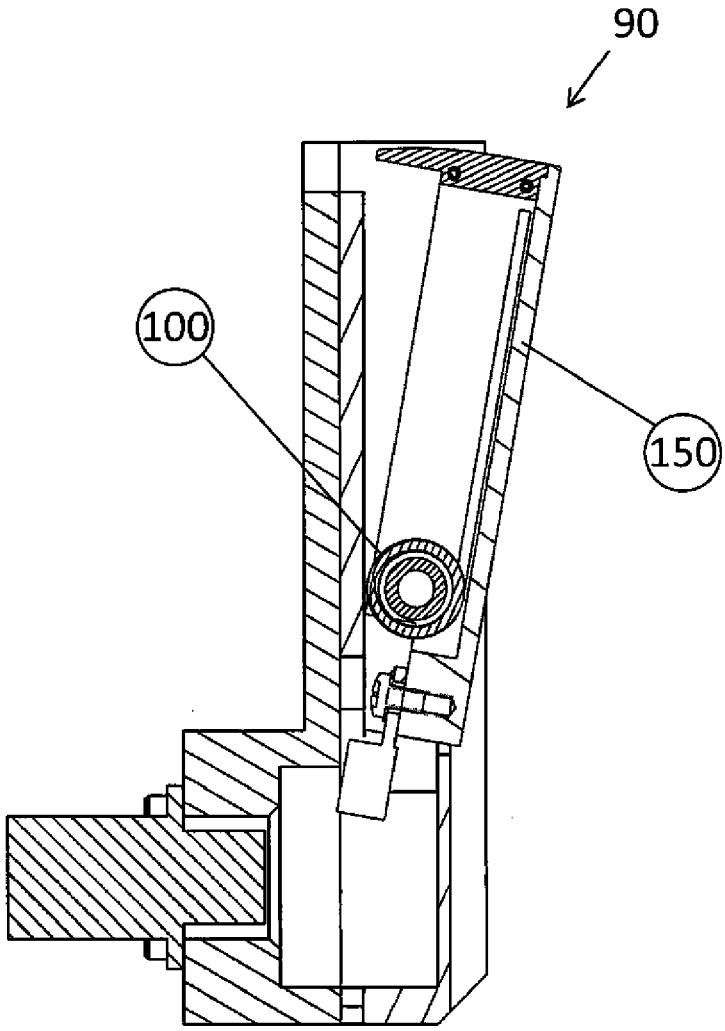
FIG. 6 is a perspective view of a cross section of a contact within the contact housing assembly.

Referring to FIG. 5, a detail of the front of contact housing on the ramp 40, one can see that all three of the contacts 90 are extended from the housing. A cross section of an extended contact is shown in FIG. 6, which shows that this contact is spring loaded by spring 100, such that the contact will extend so as to ensure that the contact face 150 will intimately mate with the corresponding shoe contact pins 70. In an alternative embodiment of the present invention, the shoe contact pins 70 can be spring loaded, or both the shoe contact pins 70 and the contacts 90 within the contact housing on the ramp 40 can be spring loaded.

Figure 8:
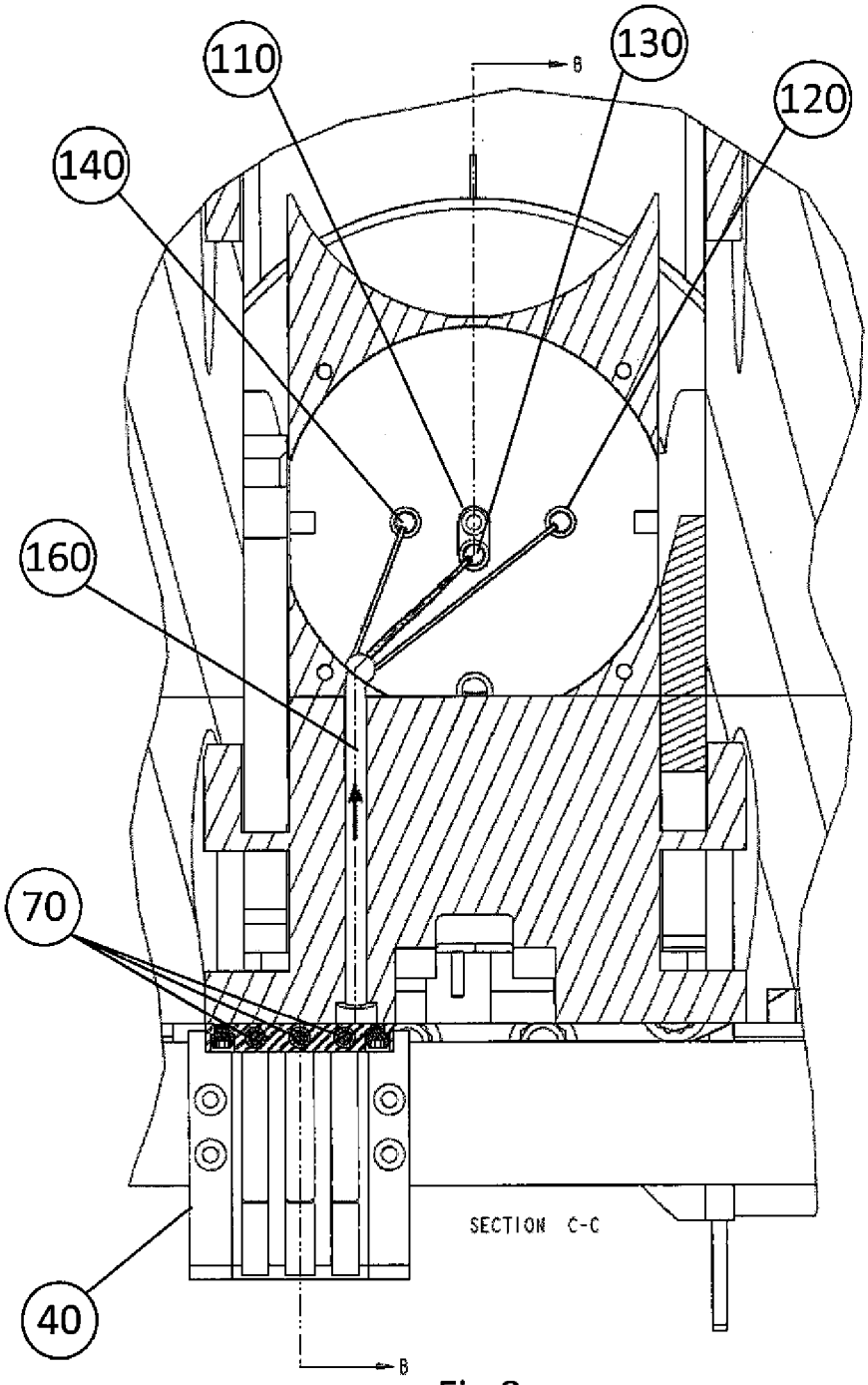
FIG. 8 is a cut-away sectional view along section C-C of FIG. 7, showing the electrical connection from the make-break assembly of the present invention to the face plate of the breechblock, which face plate is adjacent to the cartridge rear.

The rear face of modern electrically ignited cartridges are provided with a central ignition contact and one or more ring contacts for monitoring and control transmissions. The standards for the location of the ring contacts vary, such ring contacts may be located at a different radius from the central ignition point on the rear face of the cartridge. Shown in FIG. 8, a sectional view showing the make-break circuit of the present invention and the circuitry 160 there through, are the standard contact locations for such ring contacts about the face plate of the breech block, points 130, 140 and 120. Contact point 110, central to the face plate, is the location where the ignition circuit makes contact.

Figure 7:
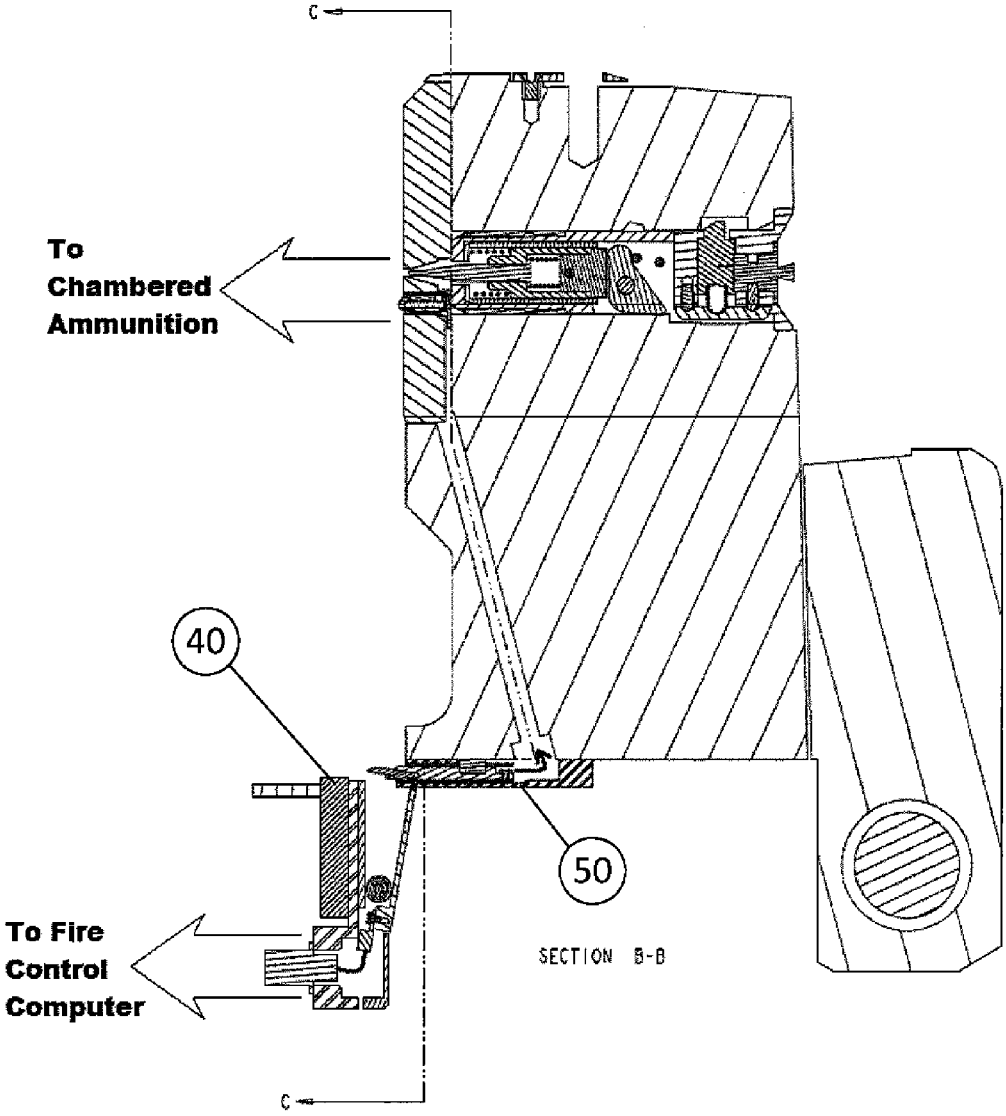
FIG. 7 is a cut-away sectional view of the make-break assembly of the present invention, including a cut-away section of the breech mechanism from FIG. 8, section B-B, showing the electrical connections therein from the Fire Control Computer to the Chambered Ammunition.

The cross-sectional view shown in FIG. 7, shows the circuitry of the present invention, wherein the contact housing on the ramp 40 is shown as connected to the Fire Control Computer and the corresponding connection through the shoe assembly 50 is channeled to the face plate of the breech block adjacent to the chambered round, i.e. the cartridge, establishing data transmission thereto—in the embodiment shown in FIG. 7, a separate ignition mechanism is shown. However, it is well understood to those in the art, that the ignition control current can be from the Fire Control Computer via the single make-break to the cartridge. In such a case, there will preferably be 4 contacts in the contact housing on the ramp 40, and four corresponding pins in the shoe assembly 50 (one contact for the ignition circuit, and three contacts for the alternative standard contact rings about the rear of alternative standard cartridges).

Although the invention has been described above in relation to preferred embodiments thereof, it will be understood by those skilled in the art that variations and modifications can be effected in these preferred embodiments without departing from the scope and spirit of the invention.

What is claimed is:

1. A make-break for a gun having breech and a wedge-type breech block, the make-break consisting of:

(a) a stationary mass which provides a cradle upon which the gun is slidably mounted to allow the gun to recoil therein when fired;

(b) a contact housing which is suspended downwardly from a mounting bracket affixed to a bottom of said stationary mass, which contact housing has a face plane which is oriented in the direction of recoil of the gun;

(c) a first set of contacts comprised of a plurality of individual parallel elongated contacts, each elongated contact extending in a rampwise fashion from the face plane of the contact housing, with a portion of each contact closest to the bottom of the stationary mass extending a greatest distance from the face plane, and with a portion of each contact farthest from the stationary mass extending a least distance from the face plane;

(d) a second set of contacts, comprised of a plurality of individual parallel fingers extending from a shoe affixed to a bottom of the wedge-type breechblock, which shoe is located such that the fingers of said second set of contacts will electrically contact with the first set of elongated contacts when the gun is in-battery and the breech is closed; and (e) whereby, when the gun is fired, the first set of contacts and the second set of contacts separate the make-break is thereby opened, and when the gun goes back into battery and breech is closed, the first and second set of contacts will align and again contact with each other.

2. The make-break for a gun having a wedge-type breech block of claim 1, wherein the first set of contacts are spring loaded to extend from said contact housing to better physically contact the second set of contacts.

3. The make-break for a gun having a wedge-type breech block-of claim 1, wherein the first set of contacts are electrically connected to a fire control computer and the second set of contacts are electrically connected to an ignition mechanism which fires a cartridge from the gun.

4. The make-break for a gun having a wedge-type breech block-of claim 1, wherein the first set of contacts are electrically connected to a fire control computer and the second set of contacts are electrically connected to a fuze within a cartridge chambered within the gun.

* * * * *